United States Patent [19]

Thompson

[11] 3,967,725

[45] July 6, 1976

[54] MATCH CONTAINER

[76] Inventor: Dennis R. Thompson, 8 Charles Plaza, Apt. 1803, Baltimore, Md. 21201

[22] Filed: Jan. 17, 1975

[21] Appl. No.: 541,994

[52] U.S. Cl. ..... 206/108; 206/109
[51] Int. Cl.[2] ..... A45F 27/00
[58] Field of Search ..... 206/91, 106–109, 206/121, 111

[56] References Cited

UNITED STATES PATENTS

| | | | |
|---|---|---|---|
| 1,196,002 | 8/1916 | Leo | 206/107 |
| 1,459,033 | 6/1923 | Pfersch | 206/109 |
| 1,849,432 | 3/1932 | Moriya | 206/109 |
| 2,003,870 | 6/1935 | St. John | 206/109 |
| 2,221,886 | 11/1940 | Van Beck | 206/109 |
| 2,249,168 | 7/1941 | Premo | 206/109 |
| 2,369,884 | 2/1945 | De Lauder | 206/109 |
| 2,604,980 | 7/1952 | Reid | 206/121 |
| 2,935,184 | 5/1960 | Olson | 206/109 |

*Primary Examiner*—Steven E. Lipman
*Attorney, Agent, or Firm*—J. Wesley Everett

[57] ABSTRACT

The improvement in a match container having a striking surface without the container, in which the striking surface is enclosed within a collapsible pocket extending outwardly from the striking surface to a distance sufficient to easily receive a portion of the match and the ignitible head after which the collapsible pocket is depressed toward the striking surface causing the ignitible head to engage the striking surface and be ignited as the match and head are withdrawn from the pocket.

1 Claim, 7 Drawing Figures

MATCH CONTAINER

The present invention relates to an improvement in a match container having a striking surface outside of the match container element in which the striking surface is enclosed within a collapsible pocket extending outwardly from the striking surface to a distance sufficient to easily receive a portion of the match and the ignitible head after which the collapsible pocket is depressed toward the striking surface, causing the ignitible head to engage the striking surface and be ignited as the match and match head are withdrawn from the pocket.

One object of the invention is to provide a match safety feature in which the match must be first removed from the container and inserted into a closed collapsible pocket having the striking surface within the pocket for igniting the same.

A further object of the invention is to provide a safety feature requiring an adult level of manual dexterity to ignite the match thereby precluding most children from hazardous play.

A still further object of the invention is to provide an enclosed pocket where ignition takes place so that any ignition material breaking off is safely confined.

Another object of the invention is to provide the pocket of such size as to receive the same without igniting the match until the sides of the pocket are pressed inwardly to press the striking surface in contact with the match head.

A further object of the invention is to provide a match container that may be produced at a substantially low cost and be practical to manufacture.

While several objects of the invention have been set forth, other objects, uses and advantages will become more apparent as the nature of the invention is more fully disclosed from the detailed description of the invention when taken in connection with the accompanying drawings, in which.

Figure 2:
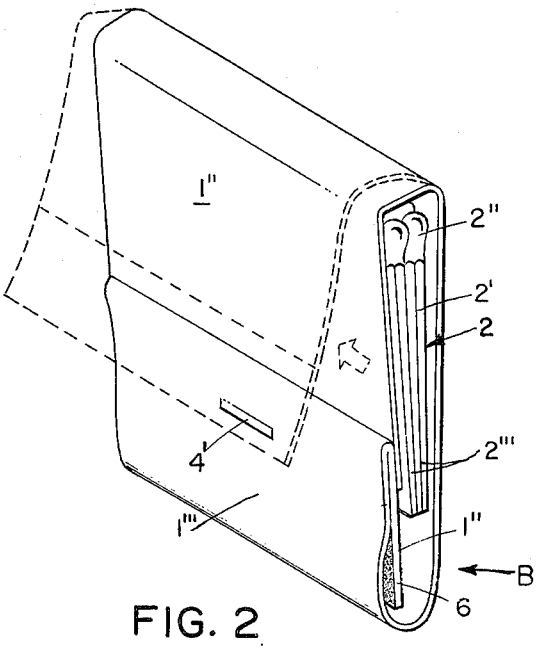
FIG. 2 is a perspective view of another form of the match container.
Figure 1:
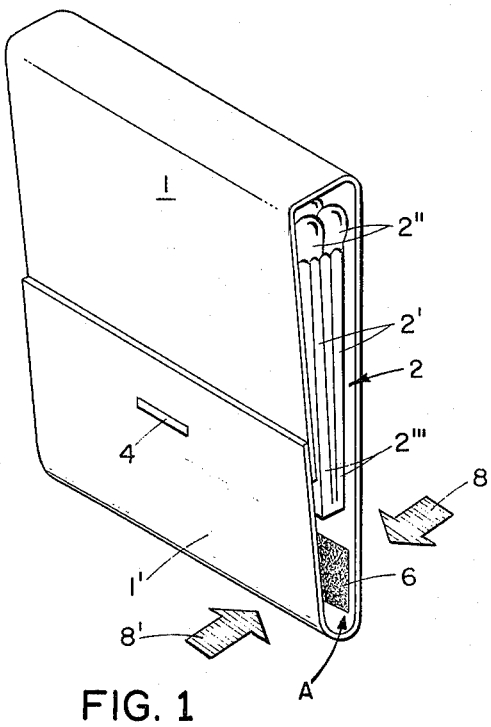
FIG. 1 is a perspective view of one form of the match container.
Figure 3:
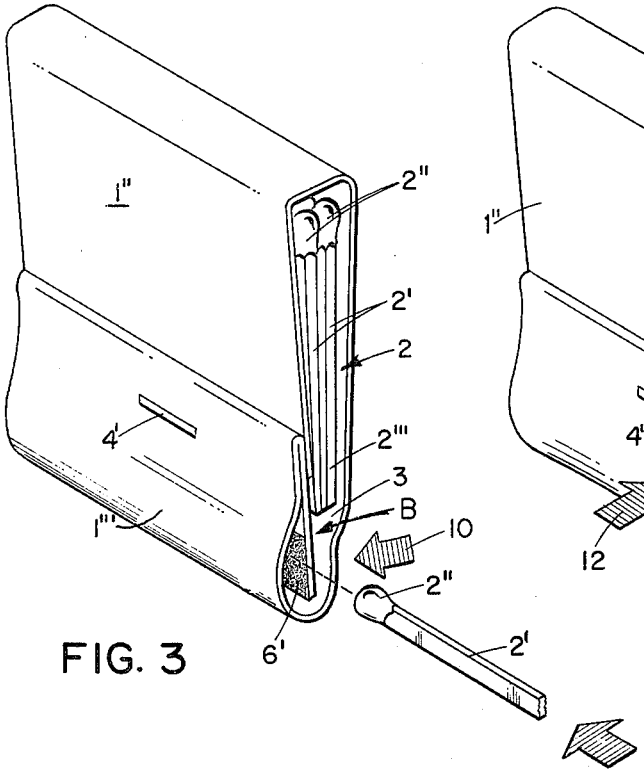
FIGS. 3 and 4 are other perspective views of the form depicted in FIG. 2.
Figure 4:
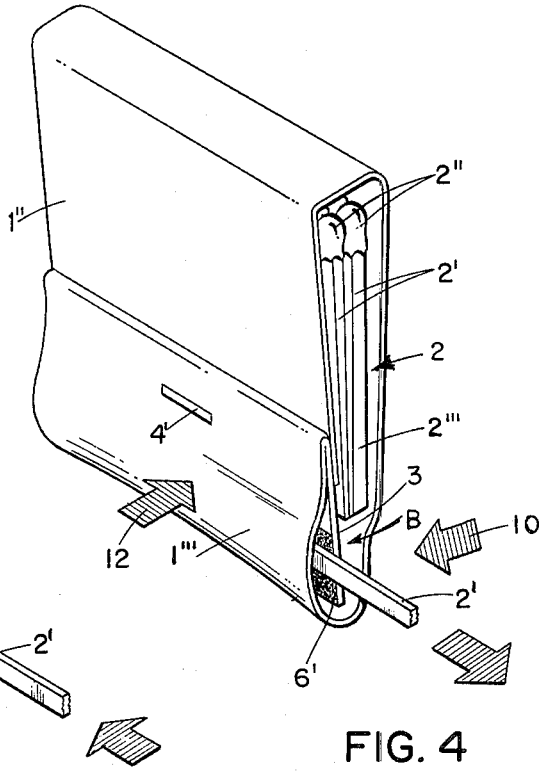

The match containers shown in FIGS. 1 to 4 are of the match book type. FIG. 1 shows one specific form of match book container, while FIGS. 2, 3 and 4 show another form of the match book container. Referring first to the form shown in FIG. 1, the container is constructed of two primary elements, an elongated rectangular strip 1 and a match pack 2. The match pack 2 comprises a plurality of match elements having a stem portion 2′ and an ignitible head 2″ positioned on one end of each of the stems and having the opposite end of the stem attached to a common base portion 2‴ from which the stems may be torn off at the time of their use. Both the rectangular strip 1 and the match pack 2 are normally made from a light cardboard or heavy paper. The strip and the case portion of the match pack 2 are assembled, preferably by a staple 4; however, any convenient fastening means may be employed.

The strip 1 is formed of a single piece of material of such length that it will form a cover for the match pack 2 and two sides of a closed pocket A in which the ends of the pocket are open. The individual match elements 2′ and the base portion 2‴ to which the match stems 2′ are attached are normally stamped from the same material to form a support for the matches while they are being carried prior to their use and from which the matches may be easily removed.

The closed pocket A extends outwardly from the bottom of the base portion 2‴ and is folded at the bottom to extend against the opposite side of the base portion where it is secured to the match pack by the staple 4 leaving a pocket of such size as to receive the ignitible head 2″ of the match element.

On one side of the extended closed pocket A is a striking surface 6. After the match has been inserted into the pocket the sides of the pocket are pressed together as indicated by the arrows 8 and 8′ forcing the match head 2″ against the striking surface 6 igniting the match when it is withdrawn from the pocket.

In the form shown in FIGS. 2, 3 and 4 the strip 1″ is formed with a closed pocket B which has its folded side 1‴ folded to form a tab 3. This tab is folded flat adjacent the inside surface of the folded side 1‴ of the pocket and stapled to the match pack by the staple 4′. The pocket B is substantially the same size as the pocket A as described for FIG. 1. A striking surface 6′ is located on the tab 3 facing the inner surface of the side 1‴ of the pocket and when in normal position lies close to the inner surface of member 1‴. When the striking surface is to be used, pressure is applied to one side of the pocket B as shown by the arrow 10, moving the pocket toward the folded side 1‴. This opens a space between the side 1‴ of the pocket and the tab 3 sufficiently to insert the match head, as shown in FIGS. 3 and 4. When the match is inserted, as shown in FIG. 4, pressure is applied as indicated by the arrows 10 and 12 forcing the match into contact with the striking surface 6′ which will ignite the match as it is withdrawn from the pocket.

Another feature of the match container is that the match head is inserted against the smooth side of the pocket and will provide a greater degree of safety in preventing accidental ignition of the match when it is being inserted into the pocket.

Figure 5:
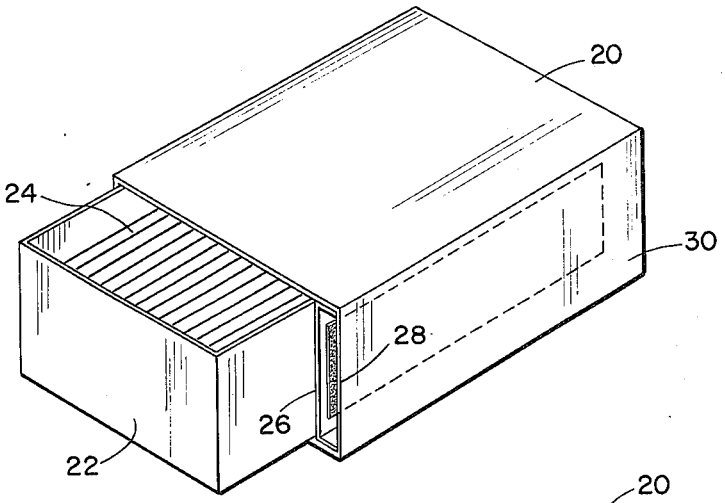
FIGS. 5, 6 and 7 are perspective views of another form of the match container.
Figure 6:
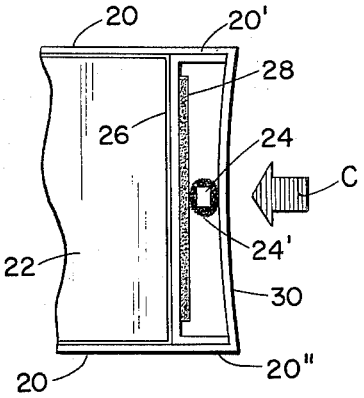
Figure 7:
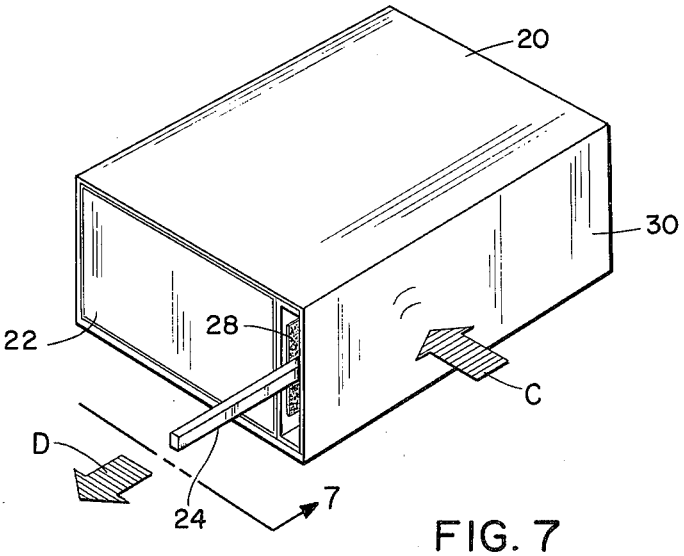

The form of container shown in FIGS. 5, 6 and 7 relates to a rigid match container for receiving the individual matches which differs from the forms shown in FIGS. 1 to 4 in which the matches are initially fastened to the container in the form of a pack. In this form there is provided a rigid cover 20 having a slideable drawer 22 in which the individual matches 24 are kept.

The drawer 24 is kept in alignment with the cover by the side member 26. The side member is provided with a striking surface 28 on the outer side thereof. Extensions 20′ and 20″ extend outwardly from the top and bottom of the cover 20 to a collapsible side piece 30 of substantially the same length as the cover. This collapsible side piece is attached to the outer ends of the extensions 20′ and 20″. These extensions and the collapsible side piece 30 form a pocket over the side of the container carrying the striking surface 28. The pocket is of a size to easily receive the match 24 and the match head 24′ when the match is inserted into the pocket before the pocket is collapsed. By compressing the side piece 30, as shown by the arrow C, the match head is pressed into engagement with the striking surface 28, and upon withdrawal of the match from the pocket, as shown by the arrow D in FIG. 7, the match head is ignited.

This match container provides an excellent safety feature in that the match must first be removed from the container and inserted into the pocket and the sides of the pocket pressed together before the match is ignited.

While the improved match container has been shown and described in several forms, it is not intended as a limitation as other forms of the invention may present themselves to those skilled in the Art; therefore, the scope of the invention is best defined in the appended claims.

I claim:

1. A match package having a match element and a cover therefor including a match striking element associated with the said cover, said cover being formed from a single strip of flexible, foldable, paper-like material having a flat central back portion to cover one side of the match element and a foldable portion at one end of the cover to cover the outer free ends and opposite side of the match elements, wherein the match elements consist of at least a single sheet having a base portion and a plurality of individual matches extending outwardly from one side of the base having one end of each of the matches attached to the base portion and an ignitible compound in the form of a head carried on the opposite free end of each of said matches, the improvement, which comprises:

a. the opposite end of the cover extending outwardly below the base of the match element and folded to form a pocket outwardly from the bottom of the base portion of the match element, the end of the cover extending outwardly below the base of the match element having a match igniting surface extending across the extreme outer edge thereof and on the same side of the cover as the match element, the outer end of the cover being folded upon itself toward the pocket and of such length as to extend in close proximity of the bottom of the pocket, staple means extending through the folded side of the pocket, the base of the match element and the back portion of the cover to form a single package unit whereby the pocket is movable towards the folded end portion of the cover carrying the igniting surface without moving the said end to provide a sufficient space between the igniting element and the inner side surface of the pocket to insert a match head for igniting said match head when the head is withdrawn from the said space in contact with the igniting surface.

* * * * *